US011174688B2

(12) United States Patent
Grensing et al.

(10) Patent No.: US 11,174,688 B2
(45) Date of Patent: Nov. 16, 2021

(54) SUCKER ROD GUIDES

(71) Applicant: Materion Corporation, Mayfield Heights, OH (US)

(72) Inventors: Fritz C. Grensing, Perrysburg, OH (US); Christopher W. Damschroder, Elmore, OH (US); Michael J. Gedeon, Mentor, OH (US); Diane M. Nielsen, Kingwood, TX (US); William D. Nielsen, Kingwood, TX (US)

(73) Assignee: Materion Corporation, Mayfield Heights, OH (US)

( * ) Notice: Subject to any disclaimer, the term of this patent is extended or adjusted under 35 U.S.C. 154(b) by 0 days.

(21) Appl. No.: 16/955,915

(22) PCT Filed: Dec. 28, 2018

(86) PCT No.: PCT/US2018/067953
§ 371 (c)(1),
(2) Date: Jun. 19, 2020

(87) PCT Pub. No.: WO2019/133870
PCT Pub. Date: Jul. 4, 2019

(65) Prior Publication Data

US 2020/0340310 A1 Oct. 29, 2020

Related U.S. Application Data

(60) Provisional application No. 62/611,250, filed on Dec. 28, 2017.

(51) Int. Cl.
*E21B 17/10* (2006.01)
*E21B 43/12* (2006.01)

(52) U.S. Cl.
CPC ..... *E21B 17/1071* (2013.01); *E21B 43/127* (2013.01)

(58) Field of Classification Search
CPC .... E21B 17/10; E21B 17/105; E21B 17/1071; E21B 17/1078; E21B 43/127
See application file for complete search history.

(56) References Cited

U.S. PATENT DOCUMENTS 1,607,941 A * 11/1926 Bowser ..... E21B 17/1071 166/241.2
1,995,095 A * 3/1935 Fitzpatrick ..... E21B 10/003 166/176

(Continued)

FOREIGN PATENT DOCUMENTS

WO WO 2015/187217 A1 12/2015

OTHER PUBLICATIONS

International Search Report dated May 8, 2019 in PCT/US2018/067953.

*Primary Examiner* — David Carroll
(74) *Attorney, Agent, or Firm* — Cozen O'Connor

(57) ABSTRACT

A sucker rod guide having low friction and high wear resistance is disclosed herein, along with a fluid extraction system comprising the same. At least a part of the exterior surface of the sucker rod guide is formed from a cold worked and spinodally-hardenable or spinodally-hardened copper alloy comprising from about 5 to about 20 wt % nickel, and from about 5 to about 10 wt % tin, the remaining balance being copper, and having a 0.2% offset yield strength of at least 75 ksi. The guide includes a smoothbore adapted to surround and engage the surface of a sucker rod. The exterior surface of the guide can include grooves miming between the two ends. In particular embodiments, the guide is made by joining together two identical guide segments. In other embodiments, the guide is a single integral piece molded around a sucker rod.

17 Claims, 14 Drawing Sheets

(56) References Cited

U.S. PATENT DOCUMENTS

| | | | | |
|---|---|---|---|---|
| 4,182,537 | A * | 1/1980 | Oster | E21B 17/1064<br>166/176 |
| 4,668,117 | A * | 5/1987 | Bair | E21B 17/1042<br>166/176 |
| 2013/0105156 | A1* | 5/2013 | Bara | F04D 29/0473<br>166/272.3 |
| 2015/0354287 | A1* | 12/2015 | Nielsen | F16L 15/00<br>166/105 |
| 2016/0276077 | A1* | 9/2016 | Grensing | B22D 21/005 |

* cited by examiner

SUCKER ROD GUIDES

CROSS-REFERENCE TO RELATED APPLICATIONS

This application is a 371 of PCT Application No. PCT/US2018/067953, filed Dec. 18, 2018, which claims priority to U.S. Provisional Patent Application Ser. No. 62/611,250, filed Dec. 28, 2017, which is incorporated by reference in its entirety.

BACKGROUND

The present disclosure relates to low friction and high wear resistant sucker rod guides made at least in part from a spinodally-hardenable copper alloy or a spinodally-hardened copper alloy. The guides are particularly useful for guiding and centering sucker rods within a conduit, also known as the production tubing, of a fluid extraction apparatus such as those made and used in the oil and gas industry. The sucker rod guides disclosed herein reduce friction and resist wear, limit damage to the inside diameter of the conduit, enhance fluid extraction, and reduce overall well operating costs, among other characteristics.

Fluid extraction apparatuses typically include a pump for extracting fluid from an underground reservoir, a conduit (also known as production tubing) through which the produced fluids travel, a power source for providing power to the pump, and a sucker rod lift system connecting the power source and the pump. Typical fluids for extraction include water, and various hydrocarbons including oil and gas.

The sucker rod lift system includes a series of sucker rods that are joined together by couplings and situated inside a conduit or production tubing. Damage to the conduit caused by repetitive contact between the outer surface of the sucker rod and the inner surface of the conduit (both of which are generally made of steel) can compromise the mechanical integrity of the conduit, leading to leakage of the fluid carried by the conduit into the environment. Such leakage effectively stops the pumping process and often leads to very costly additional operations to remediate such failures.

Damage to the conduit is generally more likely to occur in situations where the well walls are curved, such as in a deviated well (a well that travels horizontally and vertically) or a well produced by non-linear drilling processes. Sucker rod guides can be placed around the sucker rods to minimize the rods contacting the well casing, thereby reducing overall damage. However, contact will still occur between the sucker rod guides and the well casing. Hence, it would be desirable to develop new sucker rod guides having improved properties.

BRIEF DESCRIPTION

The present disclosure relates to sucker rod guides made at least in part from a spinodally-hardenable copper alloy or a spinodally-hardened copper alloy. The sucker rod guides may be uniformly made of the copper alloy, or the copper alloy may be present on only the exterior surface of the sucker rod guide (or a portion thereof), or the copper alloy may be present as inserts that are either initially exposed on the exterior surface or initially hidden within the interior of the sucker rod guide (and later exposed). The copper alloy provides the sucker rod guides with a combination of properties including high tensile strength, high fatigue strength, high fracture toughness, wear resistance, low friction, and corrosion resistance. The use of the copper alloys reduces the occurrence of destructive damage to the guides and other components in pump systems using such guides, while providing mechanical functionality and efficiency during fluid recovery operations. This also extends the useful service life of such components, significantly reducing the costs of equipment used to recover fluid from a well.

Disclosed herein in various embodiments are sucker rod guides comprising a copper-nickel-tin alloy. In some embodiments, the copper-nickel-tin alloy makes up at least a portion of the exterior surface of the sucker rod guide. In other embodiments, the copper-nickel-tin alloy is at least partially encased in a non-copper-alloy material, such as a polymeric resin.

In one embodiment, the sucker rod guide has a longitudinal body having a first end, a second end, an outer body diameter, and an exterior surface. The sucker rod guide also has a smooth internal bore in the longitudinal body extending from the first end to the second end adapted to engage a sucker rod. At least a portion of the exterior surface of the sucker rod guide comprises a copper-nickel-tin alloy.

In some embodiments, the copper-nickel-tin alloy comprising at least a portion of the exterior surface is in the form of a layer of the copper-nickel-tin alloy. This layer may contain a high percentage of the copper-nickel-tin alloy mixed with, for example, a polymeric resin. The copper-nickel-tin alloy may be dispersed as a powder within the resin, with a concentration gradient ranging from a low concentration of metal alloy powder at the center of the sucker rod guide and a high concentration of metal alloy powder at the exterior surface of the sucker rod guide.

In other embodiments, the copper-nickel-tin alloy comprising at least a portion of the exterior surface is in the form of one or more copper alloy inserts. The remainder of the sucker rod guide can be formed from alternative materials such as a polymeric resin. The copper-nickel-tin alloy may include from about 5 wt % to about 20 wt % nickel, and from about 5 wt % to about 10 wt % tin, and wherein the alloy has a 0.2% offset yield strength of at least 75 ksi.

Also disclosed herein are sucker rod guide assemblies, comprising a sucker rod and a low friction and high wear resistant sucker rod guide affixed to the sucker rod. The sucker rod guide may have a structure as described above, with the sucker rod running through the internal bore.

Further disclosed in various embodiments herein are sucker rod guide segments that can be used in pairs or combinations of separate parts to form a sucker rod guide. Such guide segments may comprise a segment body having a first end and a second end; a semicylindrical center channel having a radius and extending longitudinally through the segment body; a first sliding joint and a second sliding joint on opposite sides of an interior surface of the segment body, and adapted to permit the sucker rod guide segment to move only longitudinally relative to another associated sucker rod guide segment; and at least one aperture extending through a first side of the segment body, and adapted to permit an associated fastener to secure the sucker rod guide segment to the associated sucker rod guide segment.

In some embodiments, the first sliding joint is a pin, and the second sliding joint is a tail, such that a dovetail joint is used. Two identical guide segments can be used to form a sucker rod guide. In other embodiments, the first sliding joint and the second sliding joint are both pins, or are both tails. It is contemplated that a guide segment having two pins is used with a guide segment having two tails to form a sucker rod guide. In particular embodiments, the pin and the tail each have slanted sidewalls.

In other embodiments, the sucker rod guide segment has a plurality of apertures spaced apart from each other and extending between the first end and the second end of the segment body.

The sucker rod guide segment can further comprise at least one longitudinal groove in an exterior surface of the segment body. Sometimes, the at least one longitudinal groove spirals from the first side of the segment body to a second side of the segment body as the groove runs from the first end to the second end of the segment body. In other instances, the at least one longitudinal groove runs longitudinally from the first end to the second end of the segment body. In particular embodiments, a pair of longitudinal grooves is present in an exterior surface of the segment body on opposite sides of the segment body, each groove running longitudinally from the first end to the second end of the segment body.

The segment body may further comprise a middle portion, with the first end and the second end tapering towards the middle portion such that an outer diameter of the middle portion is greater than a diameter of the first end and the second end. The taper can be, for instance, either linear or parabolic.

The segment body can be made of a copper-nickel-tin alloy comprising from about 5 wt % to about 20 wt % nickel, and from about 5 wt % to about 10 wt % tin, wherein the alloy has a 0.2% offset yield strength of at least 75 ksi. In additional embodiments, the exterior surface of the segment body can be coated with a polymeric resin or an organic composite. The metal segment body acts as a frame for the exterior coating.

In other alternative embodiments, the segment body is made from a cured polymeric resin or an organic composite, and a copper alloy insert is present in the segment body. It is contemplated that in these embodiments, the sucker rod guide segment will wear at the start, eventually exposing the surface of the metal insert. The copper alloy insert will then retard further system wear.

Also disclosed herein are sucker rod guides, comprising: a longitudinal body having a first end, a second end, an outer body diameter, and an exterior surface; a smooth internal bore in the longitudinal body extending from the first end to the second end adapted to engage a sucker rod; and at least one groove running from the first end to the second end. These sucker rod guides can be made as one integral body, or can be made from guide segments as described above.

In some embodiments, the sucker rod guide further comprises at least one aperture extending radially from the exterior surface to the internal bore, the aperture adapted to receive an associated fastener for securing the sucker rod guide in place relative to an associated sucker rod.

Also disclosed herein are sucker rod guide assemblies, comprising: a sucker rod; and a sucker rod guide as described above. The sucker rod passes through the smooth internal bore of the sucker rod guide and is joined to the sucker rod guide.

An adhesive can be used to join the sucker rod and the sucker rod guide. Alternatively, the sucker rod guide can further comprise an aperture extending radially from the exterior surface to the internal bore, and a fastener passes through the aperture for securing the sucker rod guide to the sucker rod. Other connection means are also contemplated herein.

Further disclosed herein are pump systems comprising: a downhole pump; a power source for powering the downhole pump; and at least one sucker rod located between the downhole pump and the power source. The sucker rod guide surrounds the sucker rod, and has a structure as described above.

Further disclosed are methods of extracting a fluid from a well, comprising: connecting a downhole pump to a motor using a sucker rod string; and operating the downhole pump using the sucker rod string to extract fluid from the well. The sucker rod string comprises a set of sucker rod guides that comprise a copper-nickel-tin alloy; and wherein the copper-nickel-tin alloy includes from about 8 to about 20 wt % nickel, and from about 5 to about 11 wt % tin, and has a sliding coefficient of friction of less than 0.4 when measured against carbon steel.

In particular embodiments, the well is a deviated well or a well produced by non-linear directional drilling.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
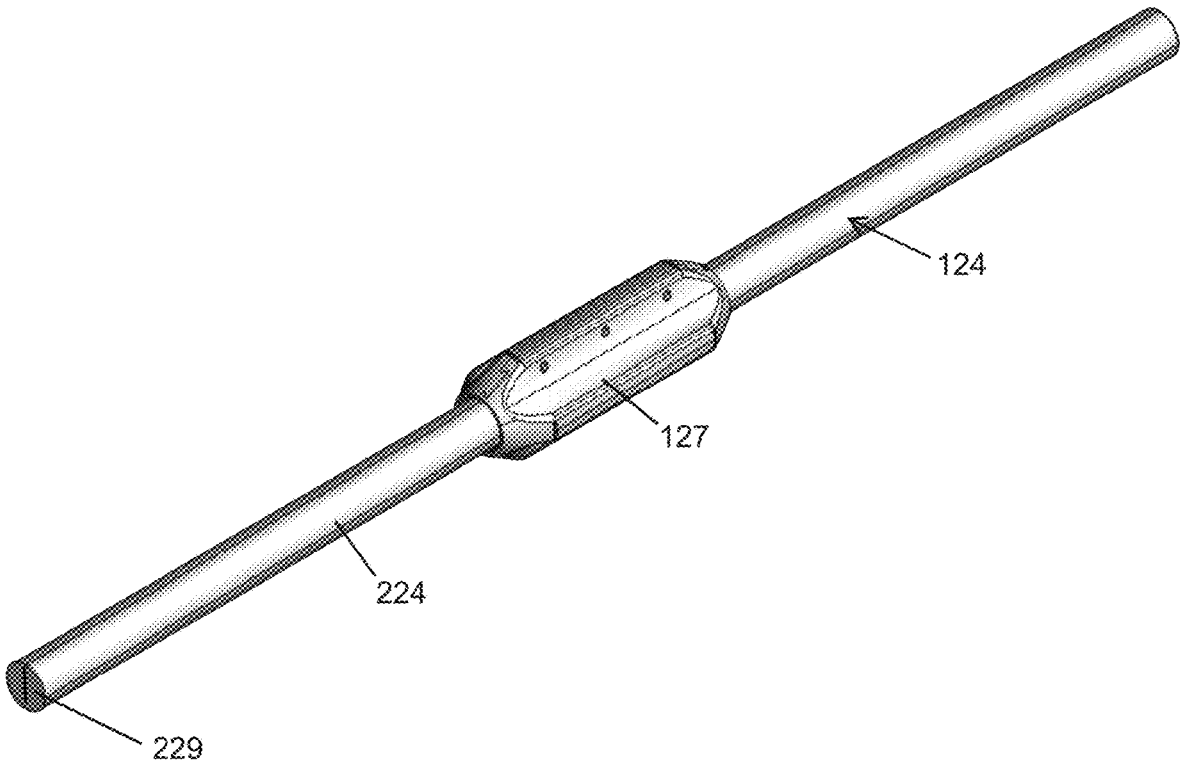
FIG. 1 is a schematic illustration of a sucker rod guide assembly in accordance with the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

The term "associated" is used in the claims to refer to an unclaimed part that helps describe or explain the function or shape of a claimed part.

The present disclosure refers to sliding coefficients of friction. Such values are measured according to ASTM G77-17, entitled "Standard Test Method for Ranking Resistance of Materials to Sliding Wear Using Block-on-Ring Wear Test", and ASTM D2714-94(2014), entitled "Standard Test Method for Calibration and Operation of the Falex Block-on-Ring Friction and Wear Testing Machine."

The present disclosure relates to sucker rod guides (and segments thereof) that are made, at least in part, from a spinodally-hardenable copper alloy or a spinodally hardened copper-based alloy. The copper alloys of the present disclosure may be copper-nickel-tin alloys that have a combination of strength, ductility, high strain rate fracture toughness, lubricity, wear resistance, and galling protection. The sucker rod guides are placed around sucker rods to keep the sucker rod from contacting the well wall/casing, thereby reducing damage and enhancing production.

Figure 10:
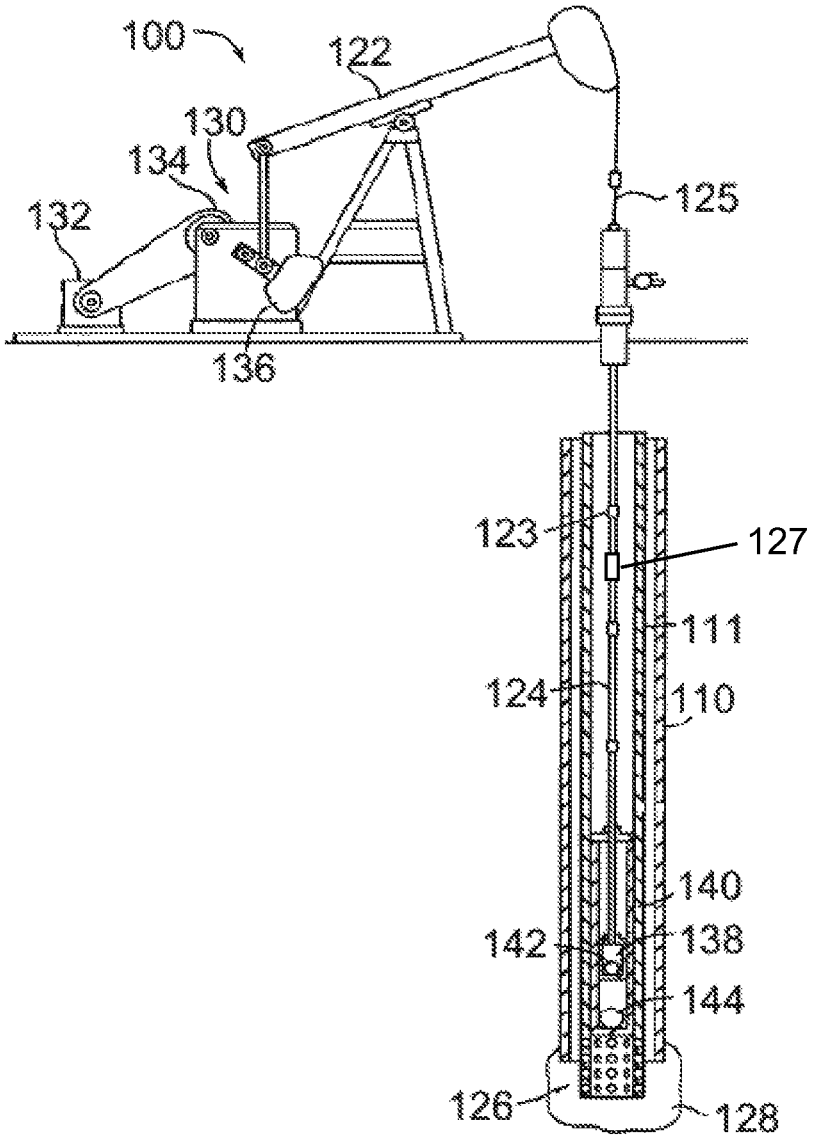
FIG. 10 is a schematic illustration of a pumping system in accordance with the present disclosure.

FIG. 10 illustrates the various parts of a pump system 100 for extracting fluid from a well, and is provided to illustrate the context in which the sucker rod guides of the present disclosure are used.

The system 100 has a walking beam 122 that reciprocates a string of sucker rods 124 that includes a polished rod portion 125. The string of sucker rods 124 is suspended from the beam for actuating a downhole pump 126 that is disposed at the bottom of a well 128.

The walking beam 122, in turn, is actuated by a pitman arm which is reciprocated by a crank arm 130 driven by a power source 132 (e.g., an electric motor) that is coupled to the crank arm 130 through a gear reduction mechanism, such as gearbox 134. The power source may be a three-phase AC induction motor or a synchronous motor, and is used to drive the pumping unit. The gearbox 134 converts motor torque to a low speed but high torque output for driving the crank arm 130. The crank arm 130 is provided with a counterweight 136 that serves to balance the string of sucker rods 124 suspended from the beam 122. Counterbalance can also be provided by an air cylinder such as those found on air-balanced units. Belted pumping units may use a counterweight that runs in the opposite direction of the rod stroke or an air cylinder for counterbalance.

The downhole pump 126 may be a reciprocating type pump having a plunger 138 attached to the end of the string of sucker rods 124 and a pump barrel 140 which is attached to the end of production tubing in the well 128. The plunger 138 includes a traveling valve 142 and a standing valve 144 positioned at the bottom of the barrel 140. On the up stroke of the pump, the traveling valve 142 closes and lifts fluid, such as oil and/or water, above the plunger 138 to the top of the well and the standing valve 144 opens and allows additional fluid from the reservoir to flow into the pump barrel 140. On the down stroke, the traveling valve 142 opens and the standing valve 144 closes in preparation of the next cycle. The operation of the pump 126 is controlled so that the fluid level maintained in the pump barrel 140 is sufficient to maintain the lower end of the string of sucker rods 124 in the fluid over its entire stroke. The string of sucker rods 124 is surrounded by a conduit 111 which in turn is surrounded by a well casing 110. The string of sucker rods below the polished rod portion 125 is made of sucker rods 124 that are held together via sucker rod couplings 123. Sucker rod guides 127 are attached to the sucker rods 124 in the string to guide and center the rods 124 in the conduit 111.

Conventional coupling geometries and materials cause rapid tubing wear due to contact between surfaces, combined with the elevated velocity of the well fluid as it exits the pump and flows through the clearance between the production tubing and the sucker rod string. This wear on both the production tubing and the sucker rod string is especially pronounced when the well is a deviated well (i.e. a well that travels horizontally as well as vertically), which can be produced by directional drilling.

Figure 11:
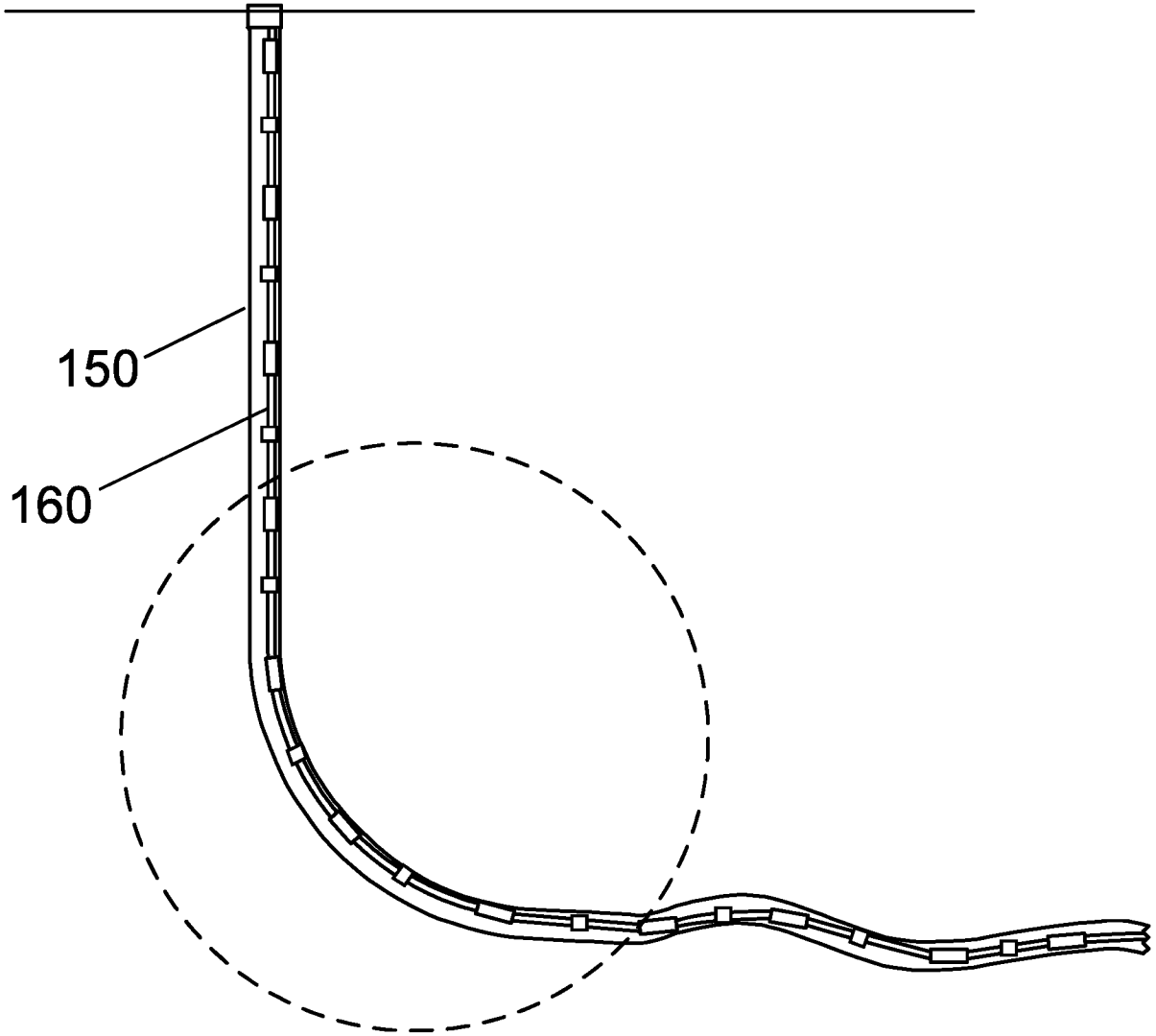
FIG. 11 is a schematic illustration of a deviated well.
Figure 12:
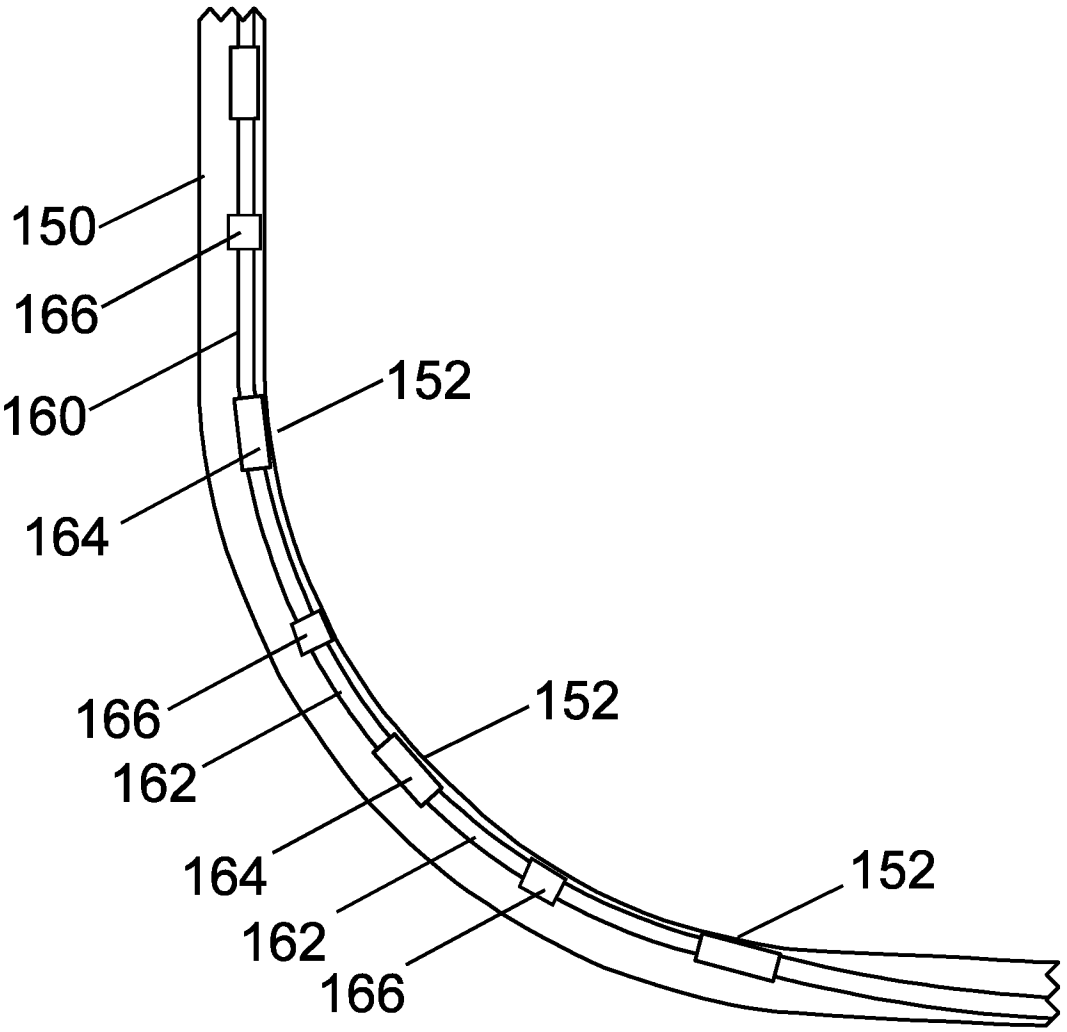
FIG. 12 is a magnified view of the kick off point (KOP) of the deviated well. The sucker rod guides can be seen contacting the production tubing, which results in wear.

In this regard, FIG. 11 is an illustration of a deviated well. FIG. 12 is a magnified view of the kick off point. As seen in FIG. 11, the conduit/tubing 150 curves in a horizontal direction, and can rise up/down in a vertical direction as well, for example to follow a fluid reservoir. A deviated well can contain multiple curves, each of which can curve in a different direction. A sucker rod string 160 is located within the conduit.

As better seen in FIG. 12, the rod string 160 is made up of sucker rods 162, sucker rod guides 164, and sucker rod couplings 166. Due to the curvature of the deviated well, the sucker rods guides 164 contact the inner wall of the conduit 150, as indicated here in locations 152. Mechanical friction in the system increases because the sucker rods, guides, and the conduit/tubing rub and wear against each other. The sucker rod string may also bend and curve.

Continuing, FIG. 1 is a perspective view of a sucker rod guide 127 attached to a sucker rod 124. The sucker rod 124 has a diameter 229. The sucker rod 124 has an outer surface 224 in contact with an interior surface (not visible) of the sucker rod guide 127. The dimensions of various sucker rods are defined by API Specification 11B, the 27th edition of which was issued in May 2010.

In accordance with some exemplary embodiments of the present disclosure, the sucker rod guide is made as a single continuous piece of material. The sucker rod guide can be machined from stock material (i.e. wrought), cast, molded, or otherwise made. Manufacturing methods for making metal objects of a given shape are known, and can be applied to make the sucker rod guide.

Referring back to FIG. 1, sucker rod guides made as a single piece can be slid onto the sucker rod 124, and then affixed using a fluid resistant adhesive or mechanical fixtures, as will be further described herein.

Figure 2A:
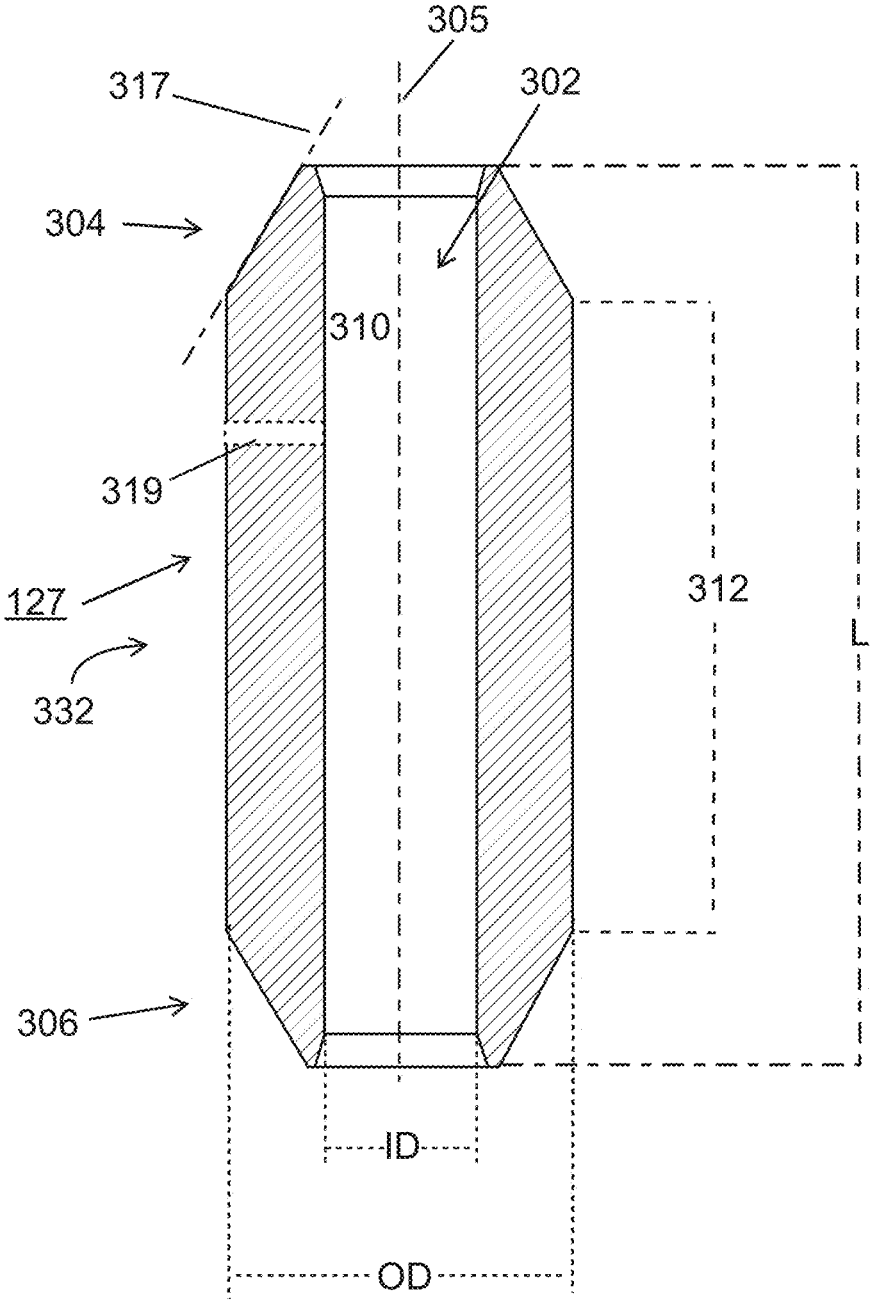
FIG. 2A is a plan cross-sectional view of the sucker rod guide of FIG. 1.
Figure 2B:
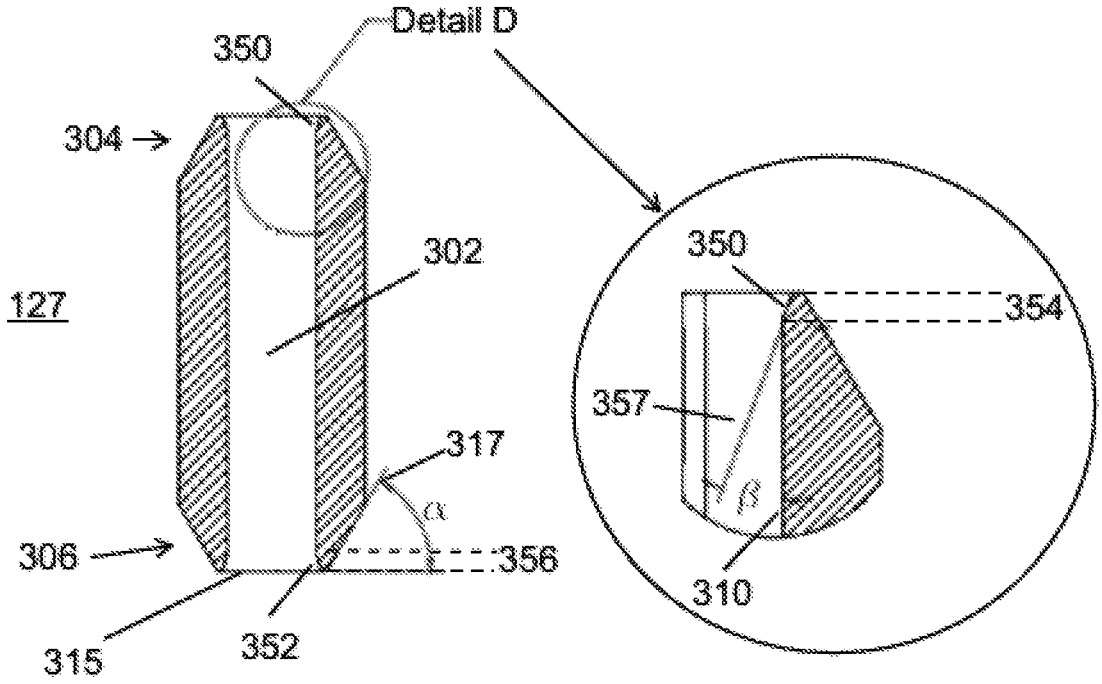
FIG. 2B is a plan cross-sectional view of the sucker rod guide of FIG. 1, showing additional detail.

FIG. 2A and FIG. 2B are cross sectional views of the sucker rod guide 127, and illustrate some aspects that apply to both single-piece embodiments and multi-piece embodiments. Starting first with FIG. 2A, the sucker rod guide 127 includes a longitudinal body 332 having a first end 304 and a second end 306. The body 332 may have a generally cylindrical shape (when seen from the top), with the length L being greater than the outer diameter, OD. The outer diameter OD of the body is greater than the outer diameter of the sucker rod (reference numeral 229 in FIG. 1).

A smooth bore 302 runs entirely through the body 332 from the first end 304 to the second end 306 along a central longitudinal axis 305 of the sucker rod guide 127. The bore 302 defines an inner surface 310 of the sucker rod guide 310. In some embodiments, the shape of the inner bore 302 is a hollow cylinder having an inner diameter ID. It is to be appreciated that the inner bore is shaped to match the dimensions of a sucker rod.

Each end of the guide 127 is tapered. The guide 127 includes first end 304, second end 306, and middle portion 312. The first end 304 and second end 306 taper towards the center of the guide such that the outer diameter OD of the middle portion 312 is greater than the diameter of each end. Thus, the ends have a taper defined by a diameter less than OD but greater than ID. The term "taper" here refers only to the diameter decreasing from the middle to each end, and does not require the change in diameter to occur in any given manner. Here, in FIG. 2A the ends of the guide taper linearly, i.e. in a straight line 317. In other embodiments, the ends of the guide taper parabolically.

Referring now to FIG. 2B, a linear taper may be at an angle $\alpha$, defined as the angle created by a horizontal line 315 parallel to an end of the guide, and taper line 317. Generally, the angle $\alpha$ is acute, i.e. less than 90°. In some embodiments, the angle $\alpha$ is about 60°.

In addition, the two ends of the bore can include inner countersinks 350 and 352 located at each end 304 and 306, respectively. The countersink portions 354 and 356 increase the diameter at the ends of the inner bore, making it easier to insert the sucker rod. Here, the countersink portions 354 and 356 increase the diameter of the inner bore towards the ends of the guide linearly, i.e. in a straight line 357. The angle of the countersink is defined as angle $\beta$, the angle created between straight line 357 and the non-countersunk inner bore surface 310. Generally, the angle $\beta$ is acute, i.e. less than 90°. In some embodiments, angle $\beta$ is about 20°.

Referring now to FIG. 1 and FIG. 2A, in some exemplary embodiments, the guide 127 is secured to a desired location on the sucker rod by an adhesive. The adhesive binds the inner bore surface 310 to the outer surface of the sucker rod (FIG. 1, 224). In some embodiments, the adhesive is a fluid resistant adhesive, meaning that the fluid extracted by the pump assembly does not degrade the adhesive nor affect its adhesive properties.

In other embodiments, the guide 127 is attached to the sucker rod by mechanical means. For example, in FIG. 2A, the sucker rod guide 127 may include a radially oriented aperture 319 (relative to the longitudinal axis 305) that receives a fastener for securing the sucker rod guide in place relative to the sucker rod. For example, the aperture may be a threaded aperture that receives a set screw, which then applies a frictional force to the sucker rod so that the guide 127 stays in a desired location about the sucker rod. Other mechanical means for fastening a device to a rod may also be used.

In accordance with other exemplary embodiments of the present disclosure, the sucker rod guide is made by combining two sucker rod guide segments. These guide segments can be machined from stock material (i.e. wrought), cast, molded, or otherwise made. The guide segment itself can be one continuous piece of material, or may be a combination of different materials as further described herein. Two such guide segments are joined together, and can be slid onto the sucker rod 124, and then attached using a fluid resistant adhesive or mechanical fixtures, as described above.

Figure 3:
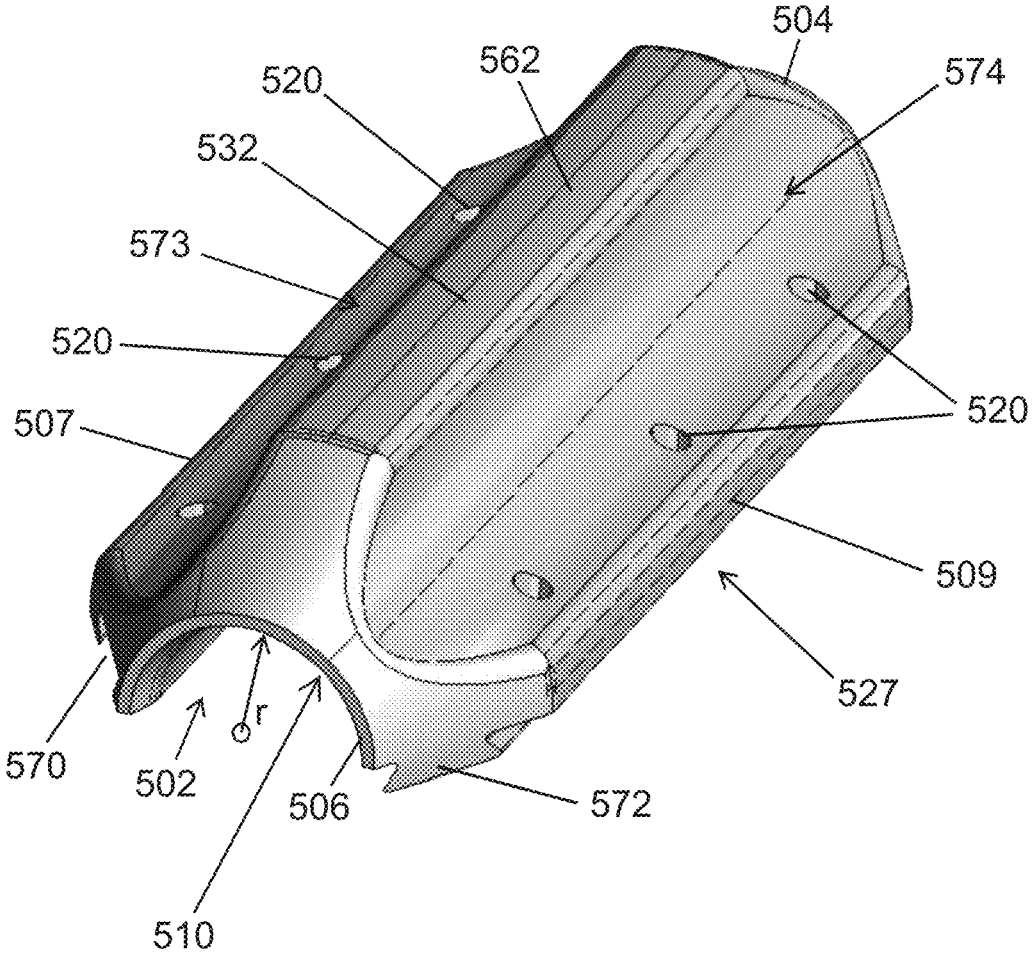
FIG. 3 is a perspective view of one embodiment of a sucker rod guide segment in accordance with the present disclosure.
Figure 4A:
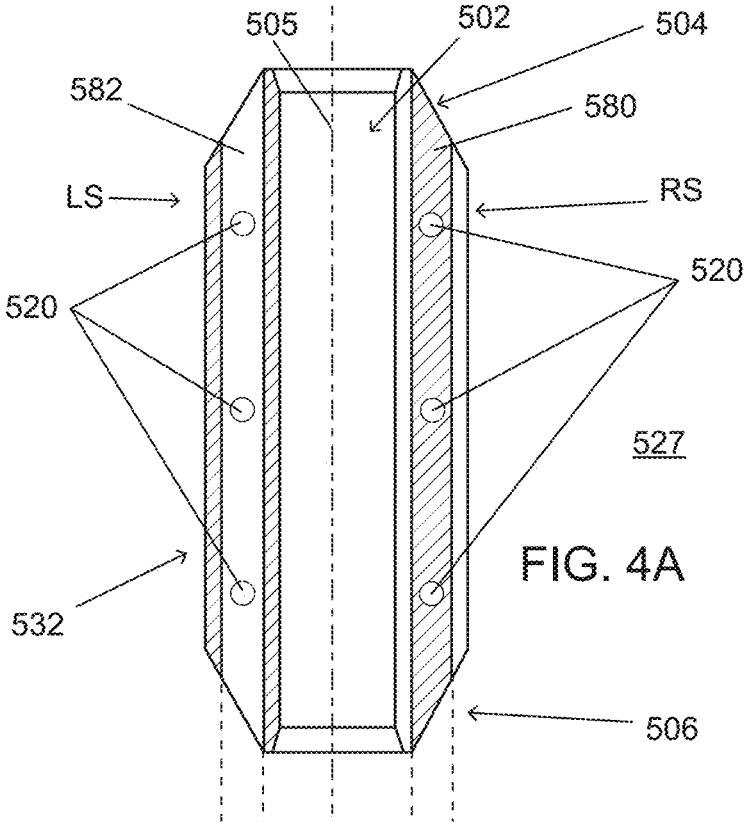
FIG. 4A is a plan view of the interior surface of the sucker rod guide segment of FIG. 2, showing more detail.
Figure 4B:
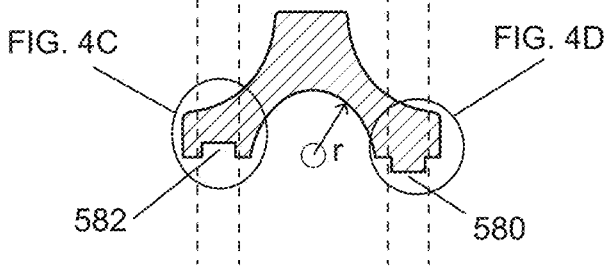
FIG. 4B is a top view of the sucker rod guide segment of FIG. 2.
Figure 4C:
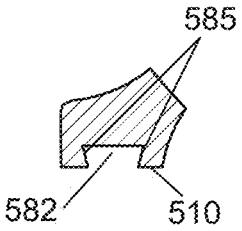
FIG. 4C is a magnified top view of the first side of the top view of FIG. 4B, showing the detail of the tail.
Figure 4D:
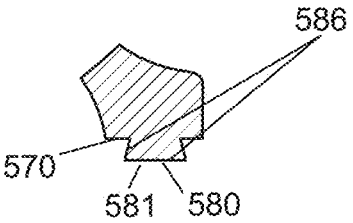
FIG. 4D is a magnified top view of the second side of the top view of FIG. 4B, showing the detail of the pin.
Figure 4E:
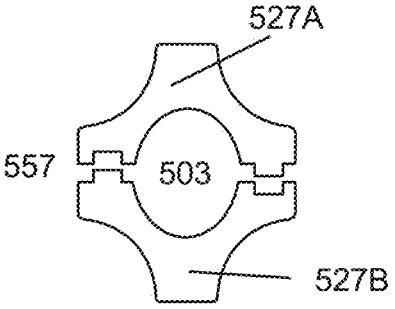
FIG. 4E is a top view showing how two identical sucker rod guide segments are joined together to form a sucker rod guide.

FIG. 3 is a perspective view of one exemplary sucker rod guide segment 527. FIG. 4A is a plan view of the interior surface of the sucker rod guide segment of FIG. 3. FIG. 4B is a top view of the sucker rod guide segment of FIG. 3. FIG. 4C is a magnified top view of the first side of the sucker rod guide segment. FIG. 4D is a magnified top view of the second side of the sucker rod guide segment. FIG. 4E shows how two sucker rod guide segments are combined to form a sucker rod guide assembly. Identical reference numerals are used in these figures to refer to identical parts.

Referring now to FIG. 3, the sucker rod guide segment 527 is formed from a segment body 532. The body 532 has a first end 504, a second end 506 opposite the first end, and an exterior surface 562. The first end and the second end are longitudinal ends, as identified by longitudinal axis 505.

The sucker rod guide segment 527 includes a semicylindrical center channel 502 that runs the longitudinal length of the guide segment and is substantially parallel with the longitudinal axis 505 of the guide segment. The center channel is formed on an interior surface 510 of the guide segment. As seen here, the channel has a semi-circular cross section with radius r. The sucker rod will engage the center channel. The surface of the center channel is entirely smooth, i.e. does not contain threads. The center channel also divides the segment body into a first side 507 and a second side 509. Put another way, the center channel is between the first side and the second side.

The exterior surface 562 of the sucker rod guide segment has at least one groove. Here, two grooves 573, 574 are shown. These grooves permit fluid flow through the conduit around the sucker rod guide. As illustrated here, the grooves run linearly from the first end 504 to the second end 506, or in other words the grooves are substantially parallel to the longitudinal axis 505. In other embodiments, the grooves extend from the first end 504 to the second end 506 non-linearly. In these exemplary embodiments, the groove runs between the two sides 507, 509 in the exterior surface as the groove extends from the first end to the second end. In some embodiments, the grooves form a spiral path around the circumference of the assembled sucker rod guide.

The sucker rod guide segment 527 includes at least one aperture 520 on the first side 507 of the segment body, which accommodates a fastener. As illustrated here, there are three such apertures on the first side 507, spaced apart from each other between the first end and the second end of the segment body. Three such apertures are also present on the second side 509 of the segment body. The apertures extend from the exterior surface 562 to the interior surface 510. Fasteners extend through the aperture(s) to secure two guide segments together. For example, the apertures may be threaded, and a threaded screw passes through the apertures 520. Other fasteners can include pins, male and female combination bolts, nuts and bolts, or snapping mechanisms or other mechanical fasteners known in the art.

The sucker rod guide segment 527 also includes a first sliding joint 570 and a second sliding joint 572. The first sliding joint is located on the first side 507 of the guide segment. The second sliding joint is located on the second side 509 of the guide segment. Each sliding joint 570, 572 is adapted to permit the sucker rod guide segment to move only longitudinally relative to/when connected to a second sucker rod guide segment. Generally, the sliding joints will extend along the entire length of the guide segment (i.e. between the two ends 504, 506) parallel to the longitudinal axis 505. As illustrated here, the sliding joints are in the form of a dovetail, or pin-and-tail arrangement.

Referring now to FIG. 4A, the interior surface 510 of the segment body 532 is visible. The first end 504, second end 506, first side 507, second side 509, and center channel 502 are labeled, along with longitudinal axis 505. As seen here, the first sliding joint on the first side 507 is a tail or socket 582, and the second sliding joint on the second side 509 is a pin 580. The pin and the tail are complementarily shaped. As also seen here, the apertures 520 extend between the two ends 504, 506. The apertures also pass through the two sliding joints.

Again, each end 504 and 506 of the sucker rod guide segment 527 is tapered. The first end 504 and the second end 506 taper from the middle portion in towards the center channel 502 of the guide segment 527, such that the outer radius of the middle portion is greater than the outer radius of the ends having a taper.

FIG. 4B is a top view (looking down the longitudinal axis at the first end 502). The tail 582 and the pin 580 are visible here. The radius r of the center channel is also indicated here.

FIG. 4C is a magnified top view of the tail 582. FIG. 4D is a magnified view of the pin 580. As seen in FIG. 4C, the tail 582 is shaped with slanted sidewalls 585. The sidewalls of the tail are slanted such that the tail is wider at its base (inside the segment body) than at the interior surface 510. Similarly, as seen in FIG. 4D, the pin 580 is shaped with slanted sidewalls 586. The sidewalls of the pin are slanted such that the pin is wider at its distal end 581 than at the interior surface 510.

In some embodiments, as illustrated in FIG. 4E, two identical sucker rod guide segments 527A, 527B are joined together to form a sucker rod guide 557. Due to the shape of the pin and tail (as seen in FIG. 4C and FIG. 4D), the two guide segments 527A, 527B are engaged by sliding the two segments together longitudinally. The pin of each guide segment engages the tail of the other guide segment. Fasteners are then inserted through the apertures (FIG. 3, 520) to fix the two guide segments together. Each guide segment 527A, 527B covers half (50%) of the sucker rod circumference. Identical parts reduce manufacturing costs and simplify operational use, as only one part needs to be made and shipped.

It is noted that due to the pin-and-tail shapes of the two sliding joints (e.g. trapezoidal), the two guide segments can only move longitudinally relative to each other when the pin and the tail are engaged. More specifically, the two guide segments cannot be pulled apart in the axis defined by the apertures 520. In use, this means that if for some reason all of the fasteners through the apertures 520 break and the adhesive joining the sucker rod guide to the sucker rod fails, the two guide segments will still not separate from the sucker rod and fall into the well casing, thus potentially causing blockage or punctures. Rather, the two guide segments should simply slide down the sucker rod until another sucker rod guide or sucker rod coupling is encountered.

In other contemplated embodiments, the sucker rod guide can be formed from two different sucker rod guide segments. One sucker rod guide segment includes pins on both sides of the interior surface, while the second complementary sucker rod guide segment includes tails on both sides of the interior surface.

Figure 5:
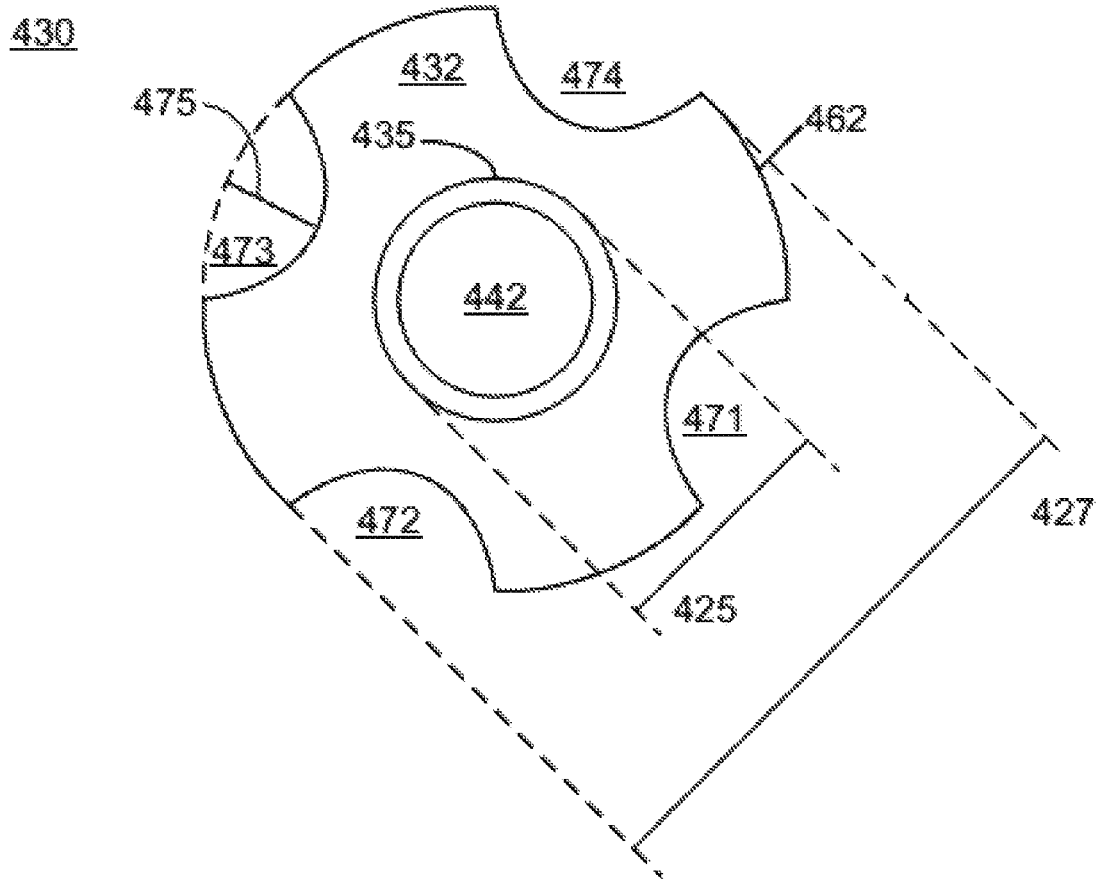
FIG. 5 is a plan view (i.e. looking down the longitudinal axis) of a sucker rod guide in accordance with the present disclosure.

FIG. 5 is a top view of the sucker rod guide (whether formed as a single piece or from multiple guide segments). The top cross section of the sucker rod guide 430 is generally circular in shape, with bore 442 running entirely through the guide along the longitudinal axis. The exterior surface 462 of the guide has at least one groove. Here, four grooves 471, 472, 473, 474 are shown. The guide has inner diameter 425 and outer diameter 427. Each groove has a depth 475, which is measured relative to the diameter of the guide. Each groove may have a desired depth, and there may be any number of grooves present. In some exemplary embodiments, the ratio of the groove depth 475 is at most one-half of the difference between the outer diameter 427 and the inner diameter 425. In other exemplary embodiments, there are a plurality of grooves, and the grooves are generally spaced evenly around the perimeter of the guide.

Figure 6:
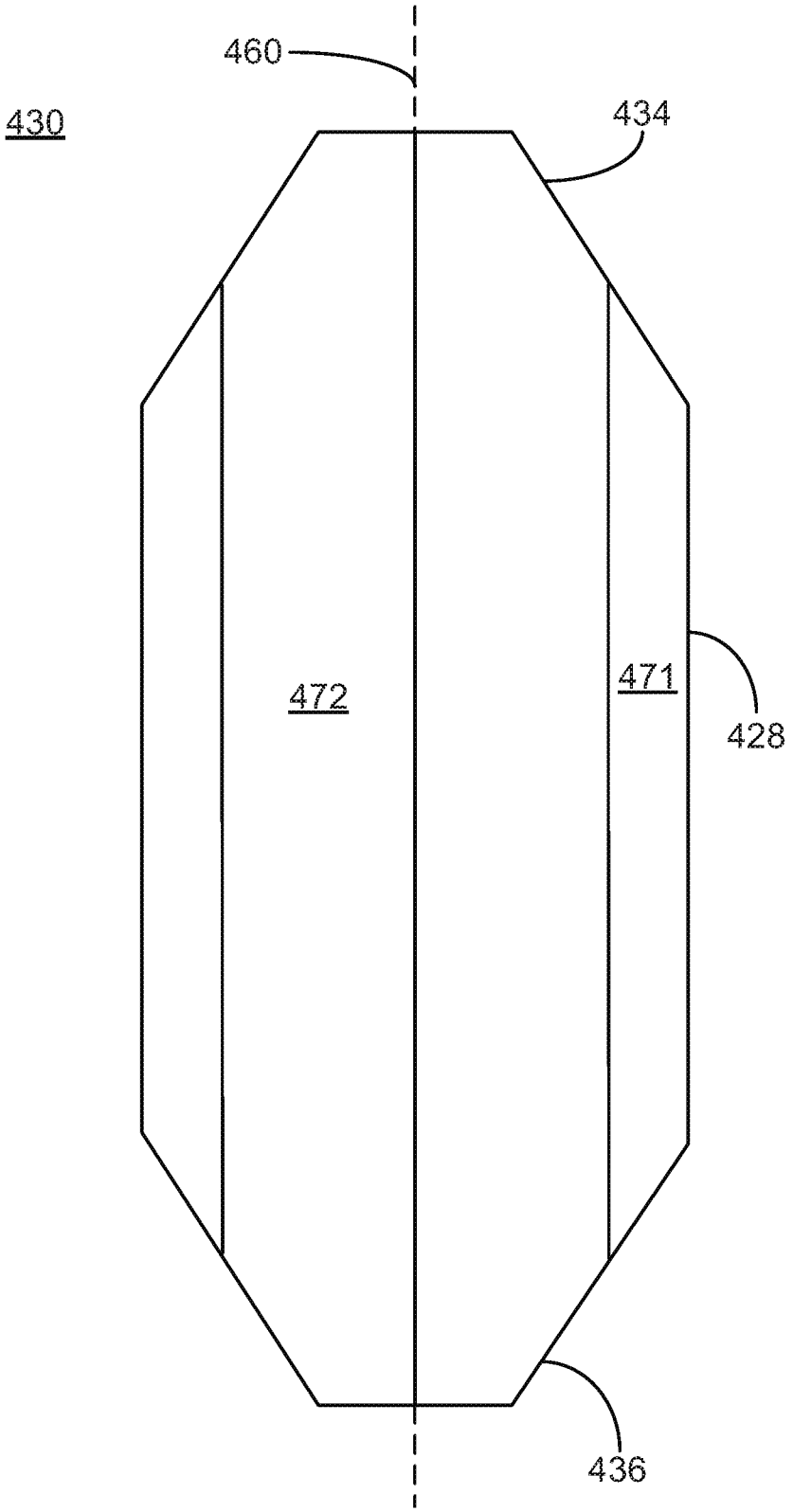
FIG. 6 is a side exterior view of a sucker rod guide with grooves running parallel to the longitudinal axis extending between the two ends of the sucker rod guide. The ends of the sucker rod guide are linearly tapered.

Referring now to the exterior view of FIG. 6, the guide has a first end 434 and a second end 436, and a middle portion 428. The first end 434 and the second end 436 taper downwards, i.e. the diameter at the middle portion 428 is greater than the diameter at each end of the guide. Again, the term "taper" here refers only to the diameter decreasing from the middle portion to each end, and does not require the change in diameter to occur in any given manner. Here in FIG. 6, the ends of the core taper linearly, i.e. in a straight line. Grooves 471 and 472 are visible as well and extend from the first end to the second end linearly substantially parallel to longitudinal axis 460.

Figure 7:
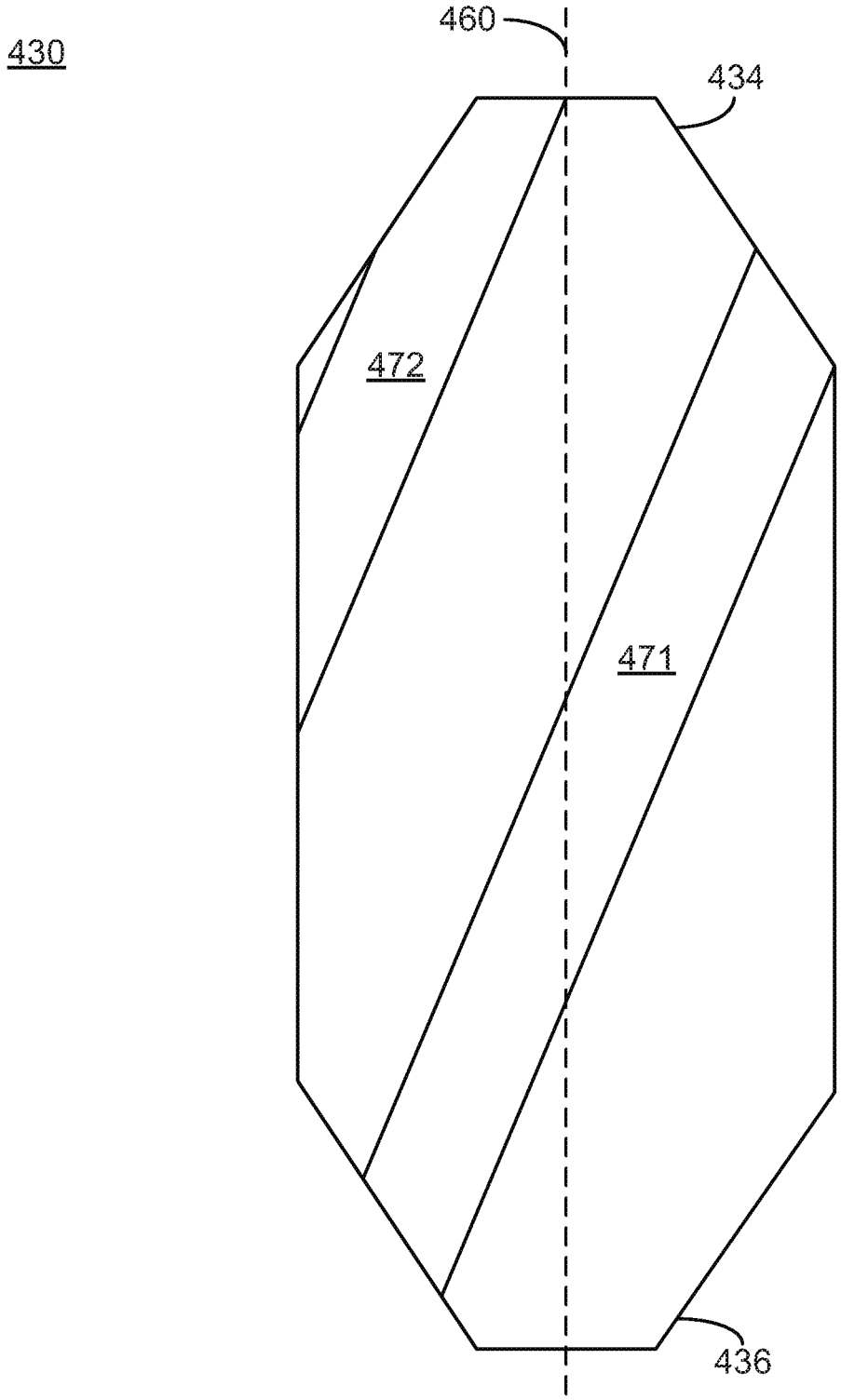
FIG. 7 is a side exterior view of a sucker rod guide with grooves running parallel to the longitudinal axis extending between the two ends of the sucker rod guide. The grooves have a spiral cross-section, i.e. are angled relative to the longitudinal axis. The ends of the sucker rod guide are linearly tapered.

FIG. 7 illustrates another aspect of the present disclosure. FIG. 7 is the side view of a sucker rod guide 430. Here, the grooves do not run parallel to the longitudinal axis 460. Rather, the grooves 471, 472 run spirally from the first end 434 to the second end 436, or put another way from one side of the perimeter to the other side of the perimeter, similar to threads on a screw. The distance along the longitudinal axis that is covered by one complete rotation of a groove (also called the lead) can be varied as desired.

Referring again to FIG. 10, the sucker rod guide 127 desirably contacts any conduit tubing 111 instead of the sucker rods 124 doing so. This reduces wear and tear on the sucker rods and the conduit tubing. The grooves on the exterior surface of the sucker rod guide provide a path for fluid flow, reducing the cross-sectional area of the sucker rod guide 127 and reducing any impedance of fluid flow due to use of the sucker rod guide.

In accordance with some aspects of the present disclosure, the sucker rod guides and sucker rod guide segments are made from a copper alloy material, or from a copper alloy material added to a polymeric resin (ie. a composite), or from a copper alloy material molded into a polymeric resin.

Generally, the copper alloy has been cold worked prior to reheating to affect spinodal decomposition of the microstructure. Cold working is the process of mechanically altering the shape or size of the metal by plastic deformation. This can be done by rolling, drawing, pressing, spinning, extruding or heading of the metal or alloy. When a metal is plastically deformed, dislocations of atoms occur within the material. Particularly, the dislocations occur across or within the grains of the metal. The dislocations over-lap each other and the dislocation density within the material increases. The increase in over-lapping dislocations makes the movement of further dislocations more difficult. This increases the hardness and tensile strength of the resulting alloy while generally reducing the ductility and impact characteristics of the alloy. Cold working can improve the surface finish of the alloy. Mechanical cold working is generally performed at a temperature below the recrystallization point of the alloy, and is usually done at room temperature.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

Spinodal alloys, in most cases, exhibit an anomaly in their phase diagram called a miscibility gap. Within the relatively narrow temperature range of the miscibility gap, atomic ordering takes place within the existing crystal lattice structure. The resulting two-phase structure is stable at temperatures significantly below the gap.

The copper-nickel-tin alloy utilized herein generally includes from about 5% to about 20 wt % nickel, and from about 5 wt % to about 10 wt % tin, with the remaining balance being copper. Put another way, the copper-nickel-tin alloy contains from about 70 wt % to about 90 wt % copper. This alloy can be hardened and more easily formed into high yield strength products that can be used in various industrial and commercial applications. This high performance alloy is designed to provide properties similar to copper-beryllium alloys.

More particularly, the copper-nickel-tin alloys of the present disclosure include from about 9 wt % to about 15 wt % nickel and from about 6 wt % to about 9 wt % tin, with the remaining balance being copper (i.e. about 76 wt % to about 85 wt % copper). In more specific embodiments, the copper-nickel-tin alloys include from about 14.5 wt % to about 15.5% nickel, and from about 7.5 wt % to about 8.5 wt % tin, with the remaining balance being copper (i.e. about 76 wt % to about 78 wt % copper).

More preferably, the copper-nickel-tin alloys comprise from about 14 wt % to about 16 wt % nickel, including about 15 wt % nickel; and from about 7 wt % to about 9 wt % tin, including about 8 wt % tin; and the balance copper, excluding impurities and minor additions. In yet other preferred embodiments, the copper-nickel-tin alloys comprise from about 8 wt % to about 10 wt % nickel and from about 5 wt % to about 7 wt % tin; and the balance copper, excluding impurities and minor additions.

Minor additions include boron, zirconium, iron, and niobium, which further enhance the formation of equiaxed crystals and also diminish the dissimilarity of the diffusion rates of Ni and Sn in the matrix during solution heat treatment. Other minor additions include magnesium and manganese which can serve as deoxidizers and/or can have an impact on mechanical properties of the alloy in its finished condition. Other elements may also be present. Impurities include beryllium, cobalt, silicon, aluminum, zinc, chromium, lead, gallium or titanium. For purposes of this disclosure, amounts of less than 0.01 wt % of these elements should be considered to be unavoidable impurities, i.e. their presence is not intended or desired. Not more than about 0.3% by weight of each of the foregoing elements is present in the copper-nickel-tin alloys. Generally, impurities and minor additions will total at most 1 wt % of the copper-nickel-tin alloys.

Ternary copper-nickel-tin spinodal alloys exhibit a beneficial combination of properties such as high strength, excellent tribological characteristics, and high corrosion resistance in seawater and acid environments. An increase in the yield strength of the base metal may result from spinodal decomposition in the copper-nickel-tin alloys.

The alloys used for making the guides and guide segments of the present disclosure may have a 0.2% offset yield strength of at least 75 ksi, including at least 85 ksi, or at least 90 ksi, or at least 95 ksi. The copper-nickel-tin alloy may also have a sliding coefficient of friction of 0.4 or less, or 0.3 or less, or 0.2 or less, when measured against carbon steel.

In more particular embodiments, the copper based alloy is commercially available from Materion under the trade name ToughMet® 3 or ToughMet® 2. ToughMet® 2 is nominally a Cu-9Ni-6Sn alloy.

ToughMet® 3 is nominally a Cu-15Ni-8Sn alloy. Depending on its grade or temper, ToughMet® 3 can have a minimum 0.2% offset yield strength of about 95 ksi to about 150 ksi; a minimum ultimate tensile strength of about 105 ksi to about 160 ksi; a minimum percent elongation of about 3% to about 18%; a minimum Rockwell Hardness C of about 22 HRC to about 36 HRC; a coefficient of friction of less than 0.3; and an average Charpy V-notch (CVN) toughness of up to 30 ft-lbs (including about 30 ft-lbs). The 0.2% offset yield strength and ultimate tensile strength are measured according to ASTM E8. The Rockwell C hardness is measured according to ASTM E18. The CVN toughness is measured according to ASTM E23. ToughMet® 3 also resists $CO_2$ corrosion, chloride SCC, pitting, and crevice corrosion. It is also resistant to erosion, HE, SSC and general corrosion (including mildly sour wells) according to NACE MRO172, Guidelines for $H_2S$ environment testing and drilling.

These properties may be present in different combinations. For example, ToughMet® 3 is offered in several grades, such as the TS95, TS120U, TS130, and TS160U grades.

The TS95 grade has a minimum 0.2% offset yield strength of about 95 ksi; a minimum ultimate tensile strength of about 105 ksi; a minimum percent elongation of about 18%; a minimum Rockwell Hardness B of about 93 HRB; and an average Charpy V-notch (CVN) toughness of about 30 ft-lbs.

The TS120U grade has a minimum 0.2% offset yield strength of about 110 ksi; a minimum ultimate tensile strength of about 120 ksi; a minimum percent elongation of about 15%; a minimum Rockwell Hardness C of about 22 HRC; and an average Charpy V-notch (CVN) toughness of about 11 ft-lbs.

The TS130 grade has a minimum 0.2% offset yield strength of about 130 ksi; a minimum ultimate tensile strength of about 140 ksi; a minimum percent elongation of about 10%; and a minimum Rockwell Hardness C of about 24 HRC.

The TS160U grade has a minimum 0.2% offset yield strength of about 148 ksi; a minimum ultimate tensile strength of about 160 ksi; a minimum percent elongation of about 3%; and a minimum Rockwell Hardness C of about 32 HRC.

Figure 8:
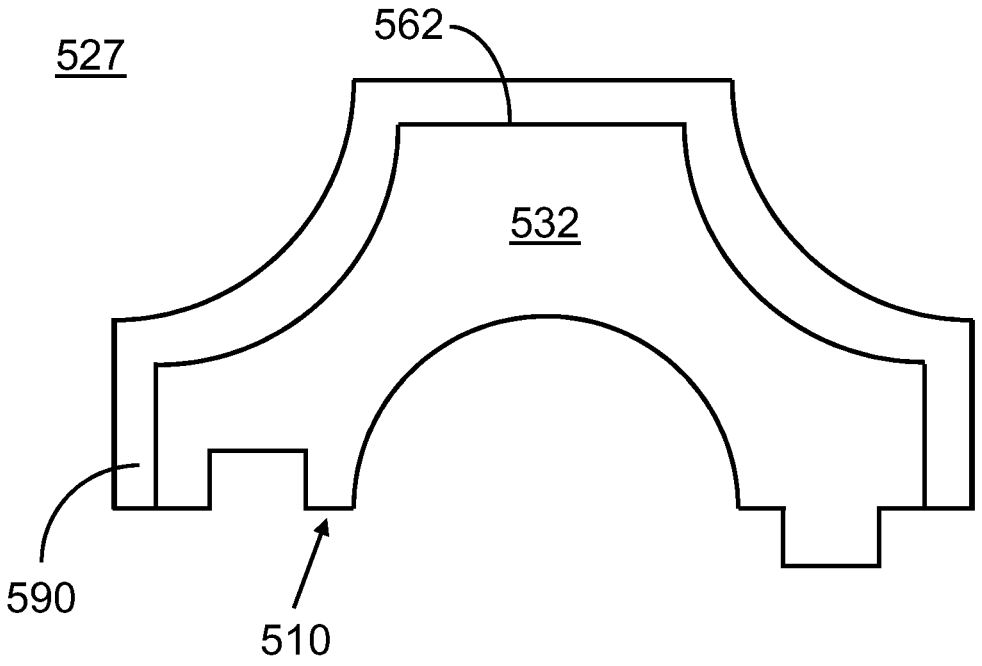
FIG. 8 is a top view of an alternative embodiment of a sucker rod guide segment according to the present disclosure. In this embodiment, the guide segment is made of a copper metal alloy, and the exterior surface of the guide segment is coated with a polymeric resin.
Figure 9:
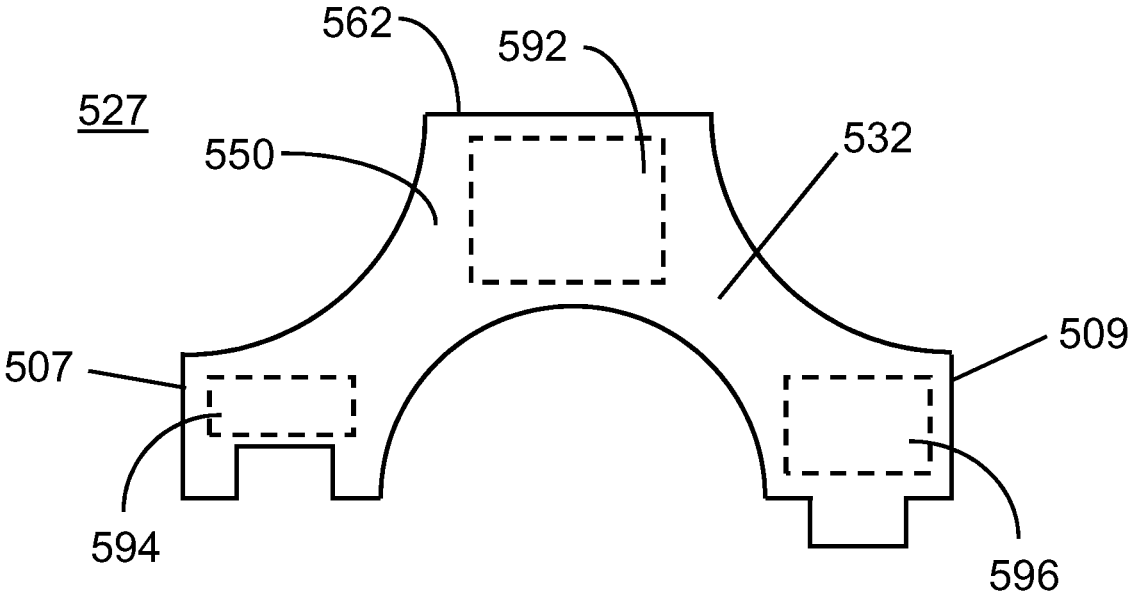
FIG. 9 is a top view of another alternative embodiment of a sucker rod guide segment according to the present disclosure. In this embodiment, the guide segment body is made of a non-copper-alloy material, such as a polymeric resin or an organic composite. One or more copper alloy inserts are present in the guide segment body, proximate the exterior surface.

FIG. 8 and FIG. 9 illustrate additional embodiments of the present disclosure. Though these two figures are of sucker rod guide segments, the discussion thereof also applies to sucker rod guides themselves.

In FIG. 8, the sucker rod guide segment 527 includes a segment body 532. The segment body is made of a copper metal alloy, such as the copper-nickel-tin alloys previously described. The exterior surface 562 of the segment body 532 is coated with a coating 590, which may be considered the outermost layer of the guide segment. The coating is made of a material that is not a copper-nickel-tin alloy. Examples of such non-copper-alloy materials include a polymeric resin or an organic composite. The segment body may have openings (not shown) to better affix the coating to the segment body. Examples of such openings may include apertures or other textures that effectively increase the area of the exterior surface. In this figure, the interior surface 510 is not coated with the coating 590, though the interior surface can also be coated.

In FIG. 9, the sucker rod guide segment 527 also includes a segment body 532. In this embodiment, the segment body is made of the material that is not a copper-nickel-tin alloy, i.e. a polymeric resin or an organic composite. One or more copper alloy inserts are located within the segment body, proximate the exterior surface 562, particularly in high wear locations. Here, three copper alloy inserts 592, 594, 596 are illustrated. Copper alloy insert 592 is located within the lobe 550 of the segment body. The lobe is the center circumferential portion of the segment body, which will contact the well casing. Copper alloy insert 594 is proximate the first side 507, and copper alloy insert 596 is proximate the first side 509. The copper alloy inserts are made of a copper alloy, such as the copper-nickel-tin alloys previously described.

In these embodiments, the copper alloy inserts can be placed in a mold during assembly, and then set in place when the material that is not a copper-nickel-tin alloy (i.e. polymeric resin or organic composite) is injected into the molding cavity and cured/hardened. The resulting sucker rod guides and sucker rod guide segments are designed to wear during initial use. Eventually, the copper alloy surfaces within the body will become exposed. This wear-resistant and lubricative surface will then retard further system wear.

The polymeric resin can be, for example, a polyolefin such as polyethylene or polypropylene; a polycarbonate; polyvinyl chloride (PVC); polystyrene; polytetrafluoroethylene (PTFE); polychloroprene; a poly aramid; or a polyamide, or other polymer suitable for oil well production environments.

Figure 13:
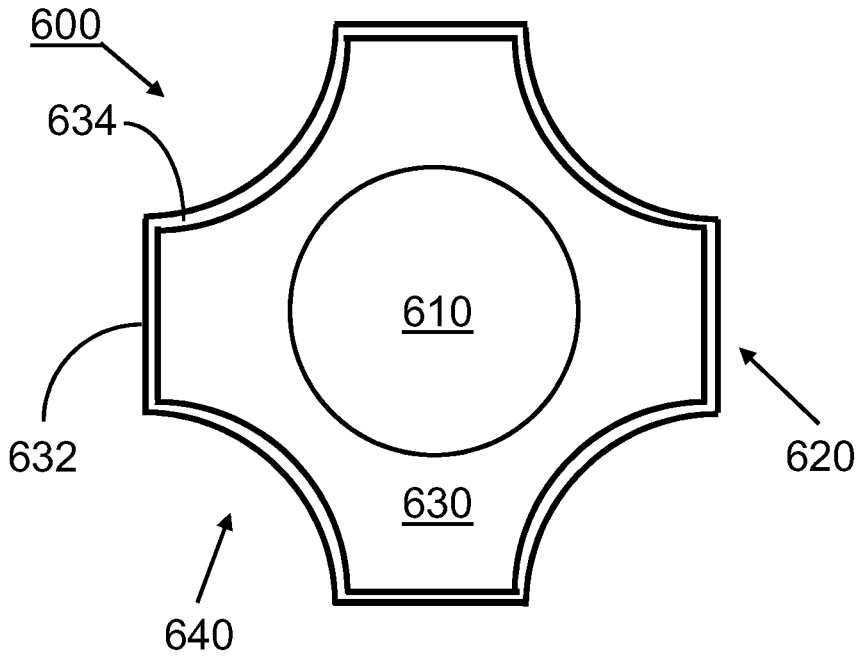
FIG. 13 is a plan view (i.e. looking down the longitudinal axis) of an additional embodiment of a sucker rod guide assembly in accordance with the present disclosure. Here, the sucker rod guide is formed by direct molding of the sucker rod guide onto the sucker rod. The sucker rod guide is made from a blend of a polymeric resin and a copper alloy powder. After the blend is molded, the sucker rod guide assembly is rotated, which causes the copper alloy powder to move preferentially to the exterior surface of the sucker rod guide.
Figure 14:
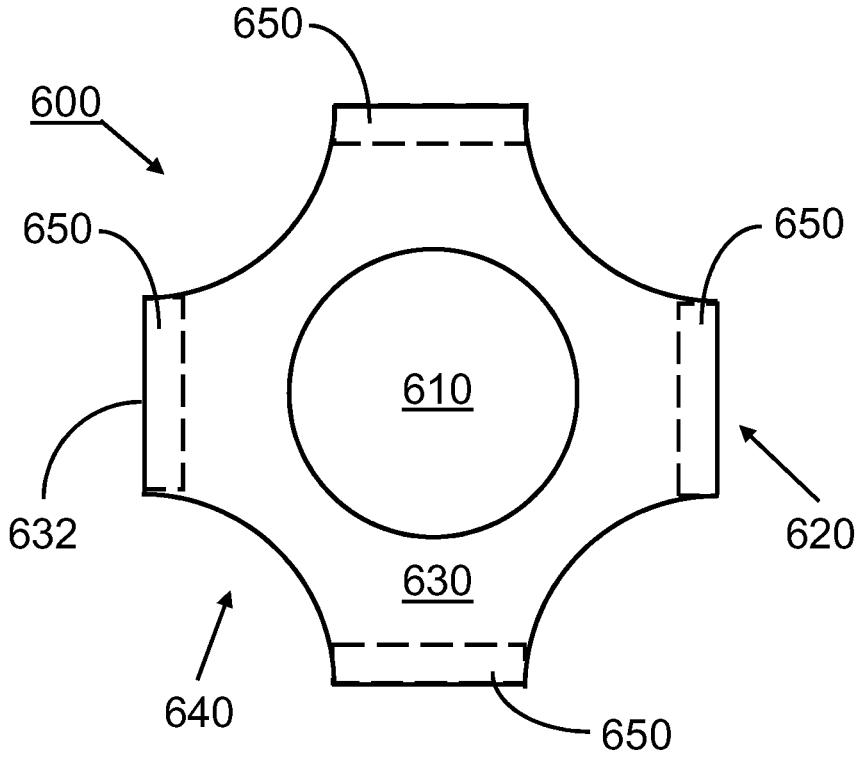
FIG. 14 is a plan view of another additional embodiment of a sucker rod guide assembly in accordance with the present disclosure. Here, the sucker rod guide is similarly formed by direct molding of the sucker rod guide onto the sucker rod. The mold and molding process permits one or more copper alloy inserts to be positioned such that the copper alloy inserts are located on the exterior surface of the sucker rod guide.

FIG. 13 and FIG. 14 illustrate additional embodiments of the present disclosure. The previous figures showed sucker rod guide segments, with two sucker rod guide segments being joined together to form a sucker rod guide, and the sucker rod guide being affixed to the sucker rod by a mechanical fastener or an adhesive. In the embodiments of FIG. 13 and FIG. 14, the sucker rod guide is formed as a single integral piece around the sucker rod. This is done, for example, by injection molding the sucker rod guide around the sucker rod. Although these two figures are of sucker rod guides, the discussion thereof also applies to sucker rod guide segments as well.

FIG. 13 is a plan view of a sucker rod guide assembly 600 in accordance with the present disclosure, similar to that of FIG. 1. The sucker rod guide assembly includes a sucker rod 610 and a sucker rod guide 620 formed around the sucker rod. The body 630 of the sucker rod guide has an exterior surface 632. Four grooves 640 are shown on the exterior surface, running longitudinally between the two ends of the sucker rod body.

Here, the sucker rod guide is formed by direct molding of the sucker rod guide onto the sucker rod. This can be done by placing the sucker rod into a mold which defines the shape of the sucker rod guide. The sucker rod is fixed in place relative to the mold. A blend of materials is then used to form the sucker rod guide. The blend is injected into the mold in a liquid state. After injection, the mold is rotated around the longitudinal axis of the sucker rod. The rotation can be at speeds ranging from 500 revolutions per minute (rpm) to 10,000 rpm. For purposes of clarity, it is noted that the sucker rod rotates along with the mold, so that the blend hardens onto the sucker rod as the resin cures.

The blend can also be considered a composite, and contains (A) a copper alloy powder and (B) a non-copper-alloy material. Examples of non-copper-alloy materials include (1) polymeric resins as previously described above, and (2) a second metal or metal alloy that is different from the copper alloy used to make the powder. The second metal or metal alloy should have a lower density and a lower melting temperature than the copper alloy powder, so the copper alloy powder can form the exterior surface of the sucker rod guide. Suitable metals or metal alloys might include aluminum or zinc, or potentially brass or bronze alloys.

Because the copper alloy powder is more dense than the non-copper-alloy material, the rotation causes the copper alloy powder to move preferentially away from the sucker rod and towards the exterior surface of the sucker rod guide itself. There can thus be a concentration gradient of the copper alloy powder in the non-copper-alloy material, with the lowest concentration of powder at the inner diameter (adjacent the sucker rod) and the highest concentration of powder on the exterior surface of the sucker rod guide. The gradient between the inner diameter and the exterior surface can be varied as desired, depending on the rotation speed and the time of rotation and other factors.

In particular, a thin layer 634 can be formed on the exterior surface of the sucker rod guide which contains a high amount of the copper alloy powder. The density of this layer or "skin" may be at least 0.18 lbs per cubic inch, and could be as high as 0.2 $lbs/in^3$. By way of comparison, polymeric resins typically have a density of about 0.03 $lbs/in^3$ to about 0.08 $lbs/in^3$, while the copper alloy powder has a density that is generally an order of magnitude greater. For example, the density of the Cu-15Ni-8Sn alloy offered under the trademark ToughMet® 3 and previously described above is 0.325 $lb/in^3$.

The blend of (A) a copper alloy powder and (B) a non-copper-alloy material may contain from about 20 wt % to about 70 wt % of the copper alloy powder and from about 30 wt % to about 80 wt % of the non-copper-alloy material. It is particularly contemplated that in some embodiments, the non-copper-alloy material is a polymeric resin.

If desired, additives can be added to the blend, although they should be selected so as not to significantly adversely affect the desired properties of the sucker rod guide. Such additives could include, for example, impact modifiers, ultraviolet stabilizers, heat stabilizers, lubricants, or antioxidant agents. The additives generally do not add up to more than 5 wt % of the blend.

The copper alloy powder can be formed via a mechanical process, a chemical process, and electrochemical process, or any combination of at least two of these types of processes. Non-limiting examples of mechanical processes include milling, crushing, and atomization. Atomization refers to the mechanical disintegration of a melt. In some embodiments, atomization is performed with high pressure water or gas. The atomization may be centrifugal atomization, vacuum atomization, or ultrasonic atomization. Non-limiting examples of chemical processes include precipitation from solution. Precipitation methods may include precipitating the alloy from a leach solution (e.g., via cementation, electrolysis, or chemical reduction). Alloyed/composite powders may be produced by co-precipitation and/or successive precipitation of different metals. Non-limiting examples of electrochemical processes may include depositing the metals on a cathode (e.g., as a powdery deposit or as a smooth, dense, and brittle deposit) followed by milling. The electrolytic cell conditions may be controlled to achieve desired particle shapes and sizes.

The copper alloy powder may have a particle size of from about 2 micrometers in diameter to about 500 micrometers in diameter. In particular embodiments, the powder material may be from about 2 micrometers to about 90 micrometers in diameter, with at least 50 vol % of the particles having a diameter of less than 80 micrometers. In some more specific embodiments, the powder may be from about 2 micrometers to about 90 micrometers in diameter, with at least 85 vol % of the particles having a diameter of less than 80 micrometers. In other desirable embodiments, the particles have a diameter of about 5 micrometers to about 100 micrometers. Alternatively, the powder particles can pass through 220 mesh.

FIG. 14 is a plan view of another sucker rod guide assembly. The sucker rod guide assembly 602 includes a sucker rod 610 and a sucker rod guide 620 formed around the sucker rod. The body 630 of the sucker rod guide has an exterior surface 632. In this illustration, four grooves 640 are shown on the exterior surface, running longitudinally between the two ends of the sucker rod body.

In this embodiment, copper alloy inserts 650 (dashed lines) are located within the body of the sucker rod guide. Here, four copper alloy inserts are located on the portions of the exterior surface that will contact the well casing. Other configurations are also contemplated. The copper alloy inserts can be of any thickness desired, and in embodiments are contemplated to have a thickness of 0.1 inches to about 0.5 inches.

It is contemplated that the sucker rod guide is also formed by direct molding of the sucker rod guide onto the sucker rod, as described above with respect to FIG. 13. The mold can be shaped to accept the copper alloy inserts and place them on the exterior surface of the sucker rod guide. The non-copper-alloy material will bond to both the copper alloy inserts and the sucker rod. The non-copper-alloy material can also include additives, as described above. Rotation of the mold may not be necessary for this embodiment, but can be performed if desired.

The sucker rod guides and sucker rod guide segments of the present disclosure can be made using casting and/or molding techniques known in the art.

Figure 15:
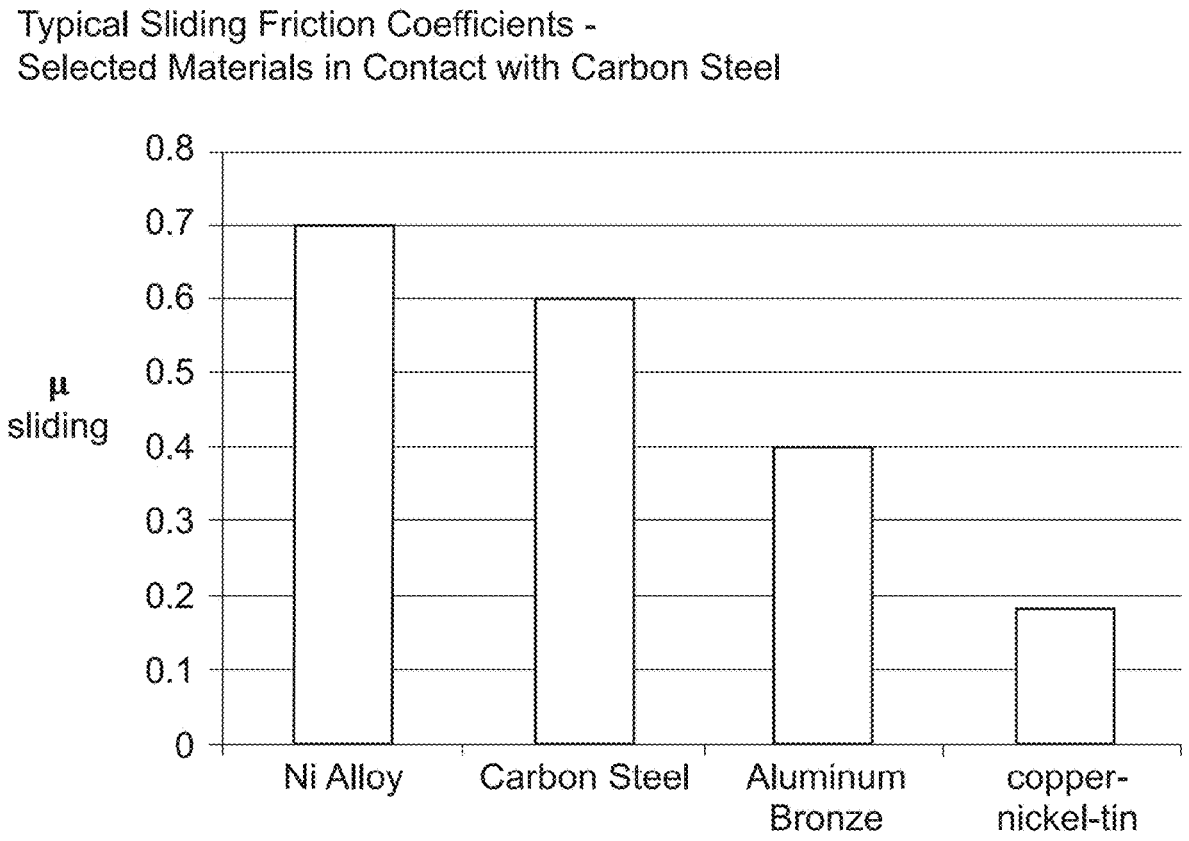
FIG. 15 is a graph illustrating typical sliding friction coefficients of various materials measured by sliding the material on carbon steel.

The copper-nickel-tin alloys of the present disclosure have very low friction. Nickel alloy in contact with carbon steel typically has a sliding coefficient of friction of 0.7. Carbon steel in contact with carbon steel typically has a sliding coefficient of 0.6. In contrast, ToughMet® 3 in contact with carbon steel typically has a sliding coefficient of less than 0.2. See FIG. 15. This will significantly reduce wear when rubbing against different parts of the pump system. It is also possible to significantly reduce overall frictional losses in the pumping system.

The use of copper-nickel-tin alloys in the sucker rod guides will result in less power usage as well as enhanced pump capacity. The alloys have a combination of low coefficient of friction; high toughness (CVN); high tensile strength; high corrosion resistance; and high wear resistance. The unique combination of properties allows the sucker rod guides to satisfy basic mechanical and corrosion characteristics needed while reliably protecting system components from galling damage, thereby greatly extending the lifetime of the system and reducing the risk of unanticipated failure. One result is longer well life between maintenance shutdowns.

The present disclosure has been described with reference to exemplary embodiments. Modifications and alterations will occur to others upon reading and understanding the preceding detailed description. It is intended that the exemplary embodiments be construed as including all such modifications and alterations insofar as they come within the scope of the appended claims or the equivalents thereof.

We claim:

1. A sucker rod guide comprising a copper-nickel-tin alloy, a longitudinal body having a first end, a second end, an outer body diameter, and an exterior surface, wherein the longitudinal body includes a non-copper-alloy material, and a smooth internal bore in the longitudinal body extending from the first end to the second end adapted to engage a sucker rod.

2. The sucker rod guide of claim 1, having a sliding coefficient of friction of less than 0.4 when measured against carbon steel; or wherein the copper-nickel-tin alloy is present on the exterior surface of the sucker rod guide; or wherein the copper-nickel-tin alloy includes from about 5 wt % to about 20 wt % nickel, and from about 5 wt % to about 10 wt % tin, and wherein the alloy has a 0.2% offset yield strength of at least 75 ksi.

3. The sucker rod guide of claim 1, wherein the copper-nickel-tin alloy is in the form of one or more copper-nickel-tin alloy inserts.

4. The sucker rod guide of claim 3, wherein the one or more copper-nickel-tin alloy inserts make up at least a portion of the exterior surface of the sucker rod guide.

5. The sucker rod guide of claim 1, wherein the non-copper-alloy material is a polymeric resin.

6. The sucker rod guide of claim 1, wherein (A) at least one groove runs from the first end to the second end; and (B) (1) wherein the at least one groove runs parallel to a longitudinal axis extending from the first end to the second end, or (2) wherein the at least one groove runs spirally from the first end to the second end.

7. A sucker rod guide assembly, comprising:

sucker rod; and a sucker rod guide affixed to the sucker rod, wherein the sucker rod guide includes:

a copper-nickel-tin alloy, a longitudinal body having a first end, a second end, an outer body diameter, and an exterior surface, wherein the longitudinal body includes a non-copper-alloy material; and a smooth internal bore in the longitudinal body extending from the first end to the second end adapted to engage a sucker rod, and wherein the sucker rod guide has a sliding coefficient of friction of less than 0.4 when measured against carbon steel.

8. The sucker rod guide assembly of claim 7, wherein the sucker rod guide is molded to the sucker rod; or wherein the copper-nickel-tin alloy is formed on at least a portion of the exterior surface of the sucker rod guide; or wherein the copper-nickel-tin alloy includes one or more copper-nickel-tin alloy inserts that form at least a portion of the exterior surface of the sucker rod guide; or wherein the copper-nickel-tin alloy includes from about 5 wt % to about 20 wt % nickel, and from about 5 wt % to about 10 wt % tin, and wherein the alloy has a 0.2% offset yield strength of at least 75 ksi; or wherein an adhesive affixes the sucker rod guide to the sucker rod.

9. A sucker rod guide segment, comprising:

a segment body having a first end and a second end;

a semicylindrical center channel having a radius and extending longitudinally through the segment body;

a first sliding joint and a second sliding joint on opposite sides of an interior surface of the segment body, and adapted to permit the sucker rod guide segment to move only longitudinally relative to another associated sucker rod guide segment; and at least one aperture extending radially through a first side of the segment body, and adapted to permit an associated fastener to secure the sucker rod guide segment to the associated sucker rod guide segment;

wherein an exterior surface of the segment body is coated with a non-copper-alloy material; or wherein the segment body is made of a non-copper-alloy material, and a copper alloy insert is present in the segment body proximate the exterior surface;

wherein the exterior surface of the sucker rod guide segment has a sliding coefficient of friction of less than 0.4 when measured against carbon steel.

10. The sucker rod guide segment of claim 9, wherein the segment body is made of a copper-nickel-tin alloy comprising from about 5 wt % to about 20 wt % nickel, and from about 5 wt % to about 10 wt % tin, wherein the alloy has a 0.2% offset yield strength of at least 75 ksi.

11. The sucker rod guide segment of claim 9, wherein the first sliding joint is a pin, and the second sliding joint is a tail.

12. The sucker rod guide segment of claim 11, wherein the pin and the tail each have slanted sidewalls.

13. The sucker rod guide segment of claim 9, wherein the first sliding joint and the second sliding joint are both pins, or are both tails.

14. The sucker rod guide segment of claim 9, wherein the at least one aperture is a plurality of apertures extending radially through the first side and spaced apart from each other longitudinally between the first end and the second end of the segment body.

15. The sucker rod guide segment of claim 9, wherein either:

(I) the sucker rod guide segment further comprises at least one longitudinal groove in the exterior surface of the segment body, wherein (A) the at least one longitudinal groove spirals from the first side of the segment body to a second side of the segment body as the groove runs from the first end to the second end of the segment body; or (B) wherein the at least one longitudinal groove runs longitudinally from the first end to the second end of the segment body; or (II) wherein the sucker rod guide segment further comprises a pair of longitudinal grooves in the exterior surface of the segment body on opposite sides of the segment body, each groove running longitudinally from the first end to the second end of the segment body.

16. The sucker rod guide segment of claim 9, wherein the segment body further comprises a middle portion, with the first end and the second end tapering towards the middle portion such that an outer diameter of the middle portion is greater than a diameter of the first end and the second end.

17. A pump system comprising:

a downhole pump;

a power source for powering the downhole pump; and at least one sucker rod located between the downhole pump and the power source; and at least one sucker rod guide surrounding the at least one sucker rod, wherein the sucker rod guide comprises:

a longitudinal body having a first end, a second end, an outer body diameter, and an exterior surface, wherein the longitudinal body includes a non-copper-alloy material, and the exterior surface, wherein at least a portion of the exterior surface comprises a copper-nickel-tin alloy; and a smooth internal bore in the longitudinal body extending from the first end to the second end adapted to engage the sucker rod; wherein the sucker rod passes through the smooth internal bore, and wherein the sucker rod guide has a sliding coefficient of friction of less than 0.4 when measured against carbon steel.

* * * * *